US007797941B2

(12) United States Patent
Munsell et al.

(10) Patent No.: US 7,797,941 B2
(45) Date of Patent: Sep. 21, 2010

(54) GAS TURBINE ENGINE SYSTEMS INVOLVING HYDROSTATIC FACE SEALS

(75) Inventors: Peter M. Munsell, Granby, CT (US); Jorn A. Glahn, Manchester, CT (US)

(73) Assignee: United Technologies Corporation, Hartford, CT (US)

( * ) Notice: Subject to any disclaimer, the term of this patent is extended or adjusted under 35 U.S.C. 154(b) by 243 days.

(21) Appl. No.: 11/924,899

(22) Filed: Oct. 26, 2007

(65) Prior Publication Data

US 2009/0107106 A1 Apr. 30, 2009

(51) Int. Cl.
*F02C 1/00* (2006.01)

(52) U.S. Cl. ..... 60/726; 60/772

(58) Field of Classification Search ..... 60/726, 60/772, 39.091, 39.39; 415/174.5
See application file for complete search history.

(56) References Cited

U.S. PATENT DOCUMENTS 4,477,088 A 10/1984 Picard
4,687,346 A 8/1987 Suciu
5,137,284 A 8/1992 Holder
5,174,584 A 12/1992 Lahrman
5,180,173 A 1/1993 Kimura
5,284,347 A 2/1994 Pope
6,145,840 A * 11/2000 Pope ..... 277/348
6,341,782 B1 1/2002 Etsion
6,676,369 B2 1/2004 Brauer
6,758,477 B2 7/2004 Brauer et al.
2004/0207158 A1 10/2004 Agrawal et al.
2007/0007730 A1 1/2007 Garrison et al.
2007/0085278 A1 4/2007 Davis et al.
2007/0149031 A1 6/2007 Martin et al.

* cited by examiner

*Primary Examiner*—Michael Cuff
*Assistant Examiner*—Vikansha S Dwivedi
(74) *Attorney, Agent, or Firm*—Kinney & Lange, P.A.

(57) ABSTRACT

Gas turbine engine systems involving hydrostatic face seals are provided. In this regard, representative compressor assembly for a gas turbine engine includes a compressor having a hydrostatic seal formed by a seal face and a seal runner.

19 Claims, 3 Drawing Sheets

GAS TURBINE ENGINE SYSTEMS INVOLVING HYDROSTATIC FACE SEALS

BACKGROUND

1. Technical Field

The disclosure generally relates to gas turbine engines.

2. Description of the Related Art

A gas turbine engine typically maintains pressure differentials between various components during operation. These pressure differentials are commonly maintained by various configurations of seals. In this regard, labyrinth seals oftentimes are used in gas turbine engines. As is known, labyrinth seals tend to deteriorate over time. By way of example, a labyrinth seal can deteriorate due to rub interactions from thermal and mechanical growths, assembly tolerances, engine loads and maneuver deflections. Unfortunately, such deterioration can cause increased flow consumption resulting in increased parasitic losses and thermodynamic cycle loss.

SUMMARY

Gas turbine engine systems involving hydrostatic face seals are provided. In this regard, an exemplary embodiment of a hydrostatic seal assembly for a gas turbine engine comprises: a compressor seal face assembly having a seal face and a mounting bracket, the mounting bracket being operative to removably mount the seal face assembly within a gas turbine engine adjacent to a compressor such that the seal face is positioned to maintain a pressure differential within the gas turbine engine during operation of the engine.

An exemplary embodiment of a compressor assembly for a gas turbine engine comprises a compressor having a hydrostatic seal formed by a seal face and a seal runner.

An exemplary embodiment of a gas turbine engine comprises: a compressor; a shaft interconnected with the compressor; and a turbine operative to drive the shaft; the compressor having a hydrostatic seal formed by a seal face and a seal runner.

Other systems, methods, features and/or advantages of this disclosure will be or may become apparent to one with skill in the art upon examination of the following drawings and detailed description. It is intended that all such additional systems, methods, features and/or advantages be included within this description and be within the scope of the present disclosure.

BRIEF DESCRIPTION OF THE DRAWINGS

Many aspects of the disclosure can be better understood with reference to the following drawings. The components in the drawings are not necessarily to scale. Moreover, in the drawings, like reference numerals designate corresponding parts throughout the several views.

DETAILED DESCRIPTION

Gas turbine engine systems involving hydrostatic face seals are provided, several exemplary embodiments of which will be described in detail. In this regard, hydrostatic face seals can be used at various locations of a gas turbine engine, such as in association with a compressor. Notably, a hydrostatic seal is a seal that uses balanced opening and closing forces to maintain a desired separation between a seal face and a corresponding seal runner. In some embodiments, the seal runner of a hydrostatic seal can be integrated into an existing component of the gas turbine engine. By way of example, the seal runner can be provided as a portion of an exterior surface of a compressor. By integrating components in such a manner, for example, a potential reduction in the overall weight of the gas turbine engine can be achieved.

Figure 1:
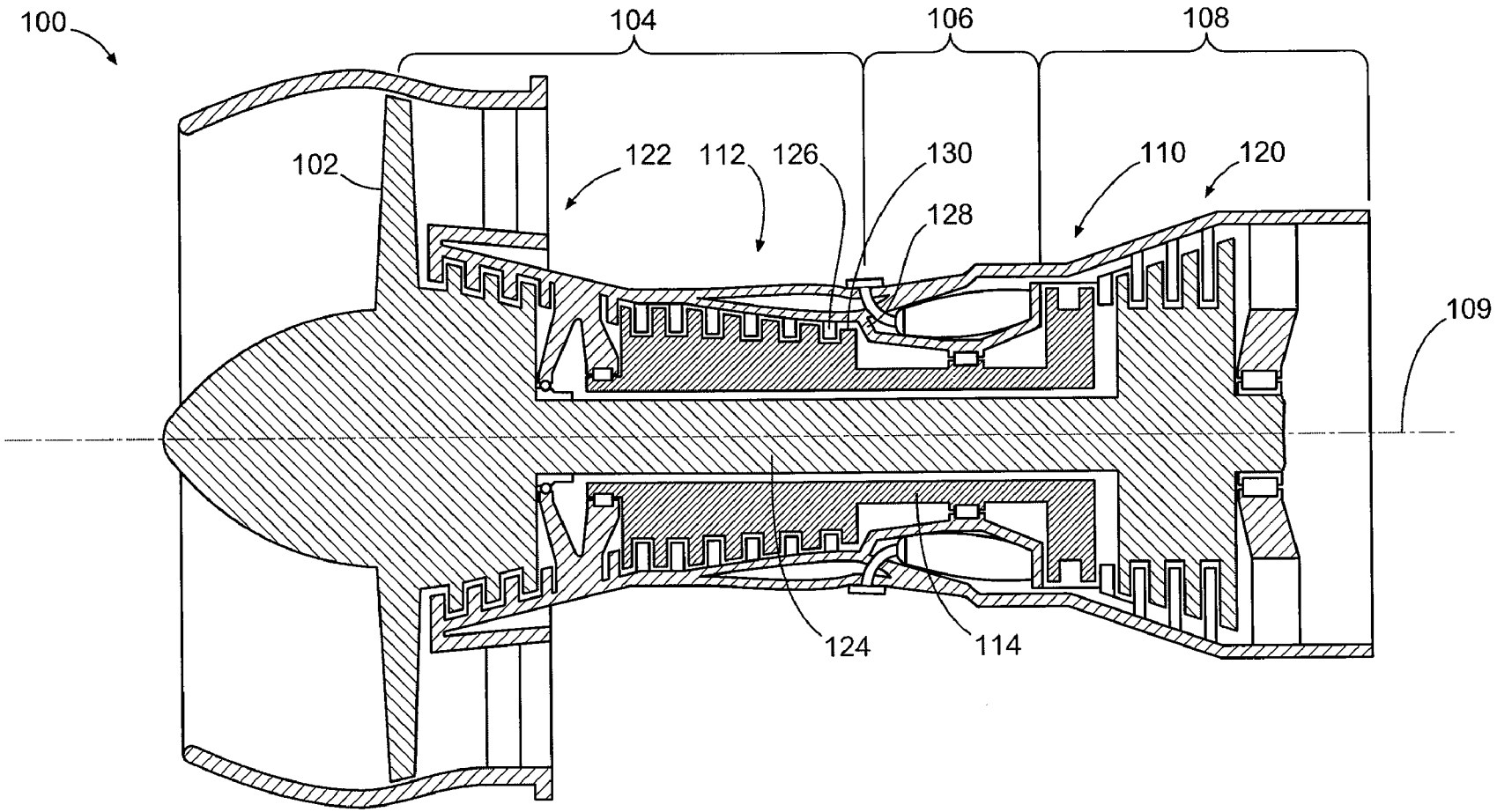
FIG. 1 is a schematic diagram depicting an exemplary embodiment of a gas turbine engine.

FIG. 1 is a schematic diagram depicting an exemplary embodiment of a gas turbine engine. As shown in FIG. 1, engine 100 is configured as a turbofan that incorporates a fan 102, a compressor section 104, a combustion section 106 and a turbine section 108 that are arranged along a longitudinal axis 109. Although the embodiment of FIG. 1 is configured as a turbofan, there is no intention to limit the concepts described herein to use with turbofans, as various other configurations of gas turbine engines can be used.

Engine 100 is a dual spool engine that includes a high-pressure turbine 110 interconnected with a high-pressure compressor 112 via a shaft 114, and a low-pressure turbine 120 interconnected with a low-pressure compressor 122 via a shaft 124. Also shown in FIG. 1 are stationary vanes 126, 128 and rotating blade 130 of the high-pressure compressor.

Figure 2:
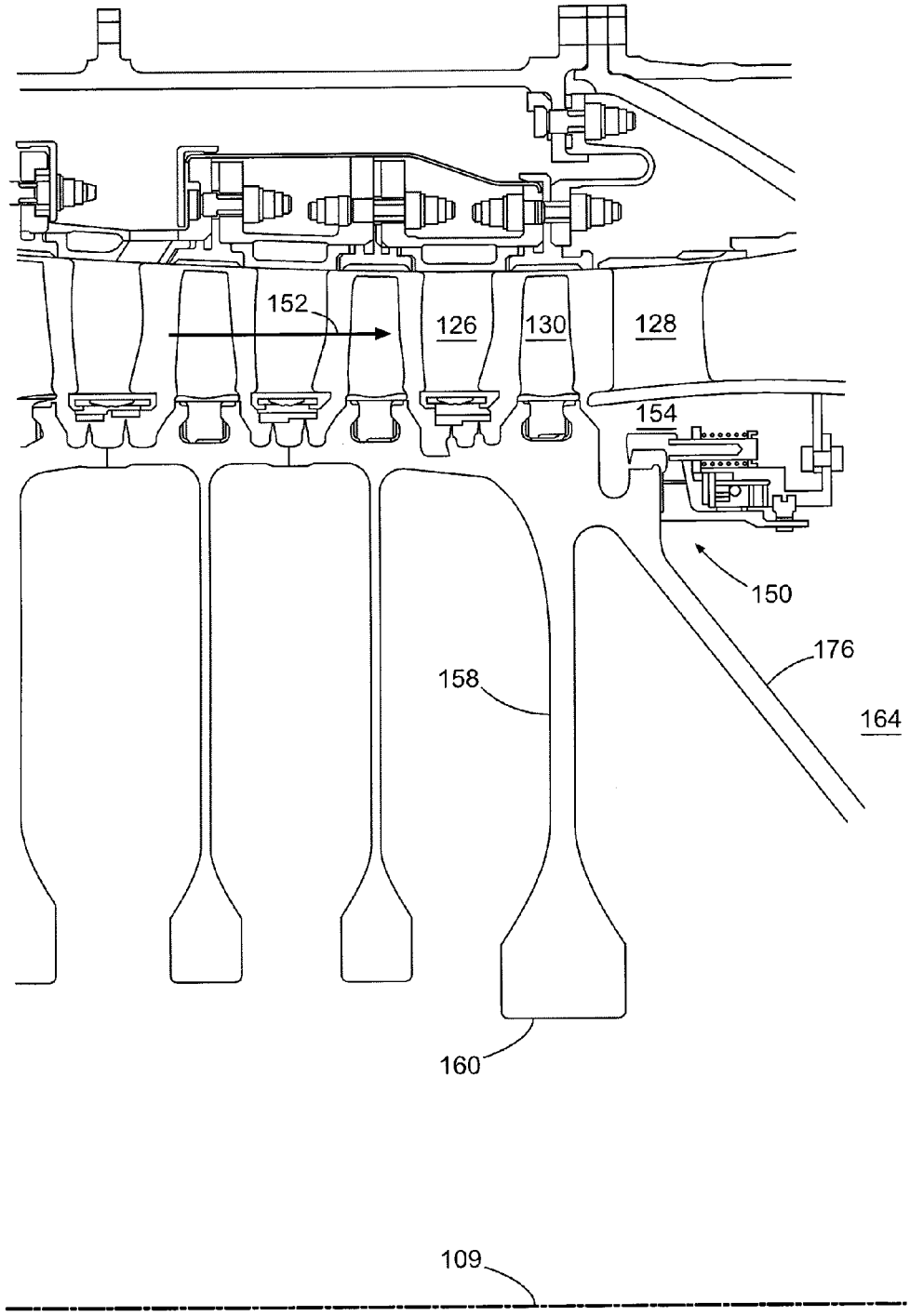
FIG. 2 is a schematic diagram depicting a portion of the exemplary embodiment of FIG. 1.

As shown in greater detail in FIG. 2, high-pressure compressor 112 incorporates a hydrostatic face seal 150. It should be noted that although the embodiment of FIGS. 1 and 2 incorporates a hydrostatic face seal in the high-pressure compressor 112, such seals are not limited only to use with high-pressure compressors.

As shown in FIG. 2, high-pressure compressor 112 defines a primary gas flow path 152 along which multiple rotating blades (e.g., blade 130) and stationary vanes (e.g., vanes 126 and 128) are located. A portion of the primary gas flow is fed through an inner diameter bleed downstream of blade 130 into a high-pressure cavity 154, which is located radially inward of vane 128.

A relatively lower-pressure cavity 164 is oriented adjacent to the high-pressure cavity 154, with hydrostatic face seal 150 being provided to maintain a pressure differential between the high-pressure cavity and the lower-pressure cavity. Notably, the seal 150 is configured to maintain the pressurization of the lower-pressure cavity, thereby tending to reduce the forward load on an associated thrust bearing (not shown in FIG. 2).

Figure 3:
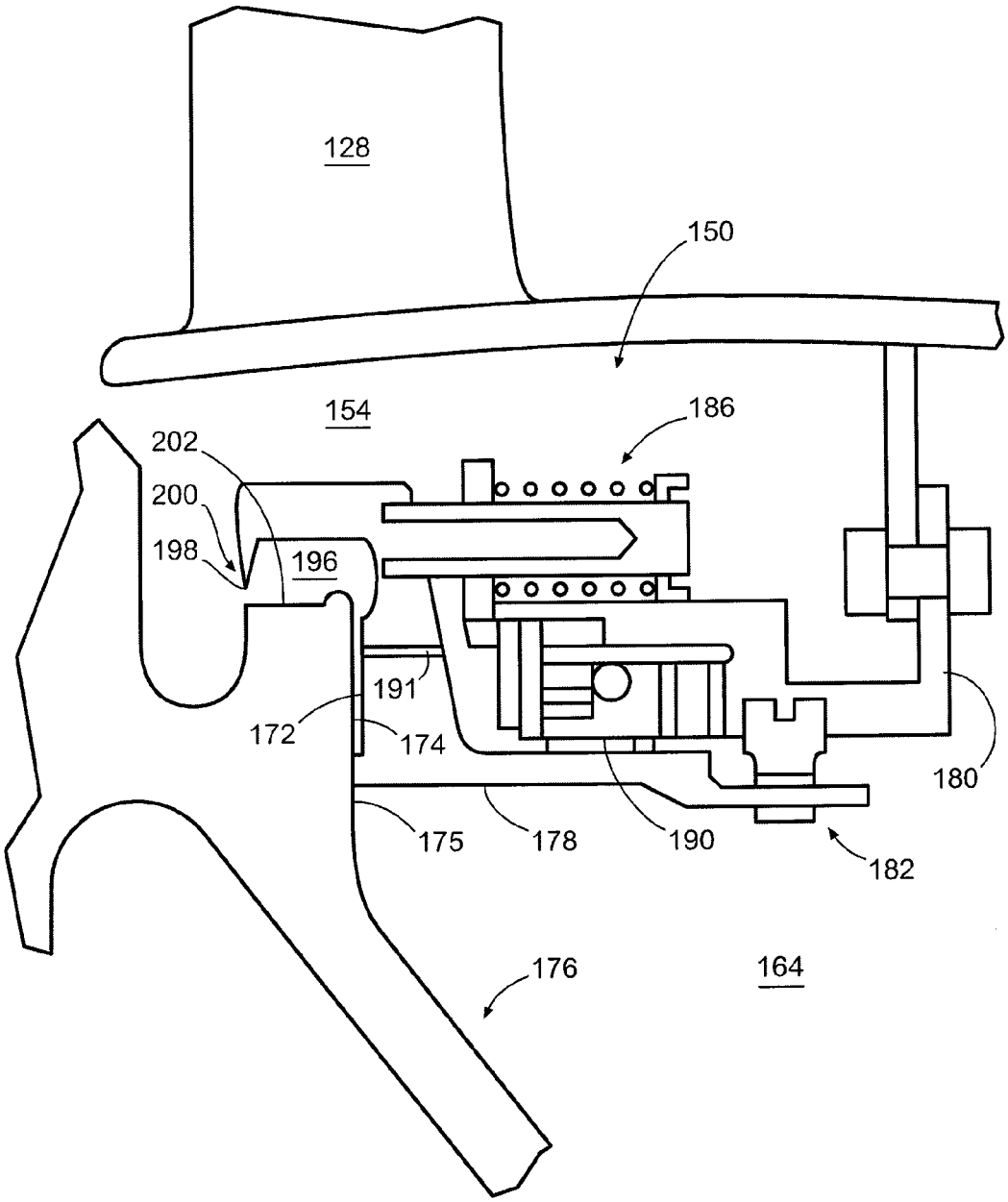
FIG. 3 is a schematic diagram depicting the exemplary embodiment of the face seal of FIG. 2 in greater detail.

FIG. 3 schematically depicts hydrostatic face seal 150 of FIG. 2 in greater detail. As shown in FIG. 3, hydrostatic face seal 150 incorporates a seal face 172 and a seal runner 174. In some embodiments, the seal face can be formed of carbon such as those implementations in which the temperature does not exceed the operating temperature of carbon. However, in the embodiment of FIG. 3, metal forms the seal face due the local air temperature being in excess of the carbon material capability during operation.

The seal runner 174 is integrated with and formed by a dedicated surface of an existing engine component, in this case, surface 175 of a compressor hub 176. As such, a separate seal runner component (and potentially one or more associated mounted brackets and multiple fasteners) is not required. Other embodiments also can use a separate component (e.g., a removable mounting bracket) for implementing a seal runner. Notably, although depicted in this embodiment as being incorporated into the rear compressor hub, various other components may provide an appropriate surface for use as a seal runner. For instance, a compressor bore (e.g., bore 160 (FIG. 2)), a compressor web (e.g., web 158 (FIG. 2)) or any feature that would allow for a film of air to form in an area where a pressure differential is required may be used.

In operation, the pressure differential between the high-pressure cavity and the lower-pressure cavity causes the stationary seal face to move toward the rotating seal runner. This movement continues until the hydrostatic load, created by high-pressure airflow from orifices 191, is sufficient to retard the motion. Specifically, the seal face rides against a film of air during normal operating conditions that increases the durability and performance of the seal.

In this regard, the seal face is positioned by a carrier 178 that can translate axially with respect to stationary mounting bracket 180, which is attached to a non-rotating component of the engine. An anti-rotation lock 182 also is provided to prevent circumferential displacement and to assist in aligning the seal carrier to facilitate axial translation.

A biasing member 186 (e.g., a spring) is biased to urge the carrier and the seal face away from the seal runner until the pressure of chamber 154 overcomes the biasing force. Multiple biasing members may be spaced about the stationary mounting bracket and carrier. Additionally, a secondary (annular) seal 190 is provided to form a seal between the stationary mounting bracket and carrier.

It should be noted that in the embodiment of FIG. 3, an intermediate pressure region 196 is formed upstream of the hydrostatic face seal 150. In particular, seal 150 includes a knife edge 198 in conjunction with a land 200 to form intermediate pressure region 196. The land is provided by a corresponding surface 202 of the compressor hub. It should be noted that since the seal runner 175 and seal carrier 178 of this embodiment are both formed of metal alloys, these two components should not be permitted to come into contact with each other due to operating temperatures. This is accomplished by design of an air bearing with sufficient hydrostatic load that is intended to preclude contact.

It should be emphasized that the above-described embodiments are merely possible examples of implementations set forth for a clear understanding of the principles of this disclosure. Many variations and modifications may be made to the above-described embodiments without departing substantially from the spirit and principles of the disclosure. By way of example, hydrostatic face seals configured as lift-off seals can be used. All such modifications and variations are intended to be included herein within the scope of this disclosure and protected by the accompanying claims.

The invention claimed is:

1. A hydrostatic seal assembly for a compressor of a gas turbine engine comprising:

a carrier having orifices that extend therethrough to supply a high-pressure airflow along a metal seal face;

a mounting bracket that positions the seal face within the gas turbine engine so as to maintain a pressure differential within the gas turbine engine during operation of the engine;

a compressor component disposed at an outer diameter of the compressor and having a metal seal runner integral thereto, the seal runner interfacing with the seal face; and a knife edge and land disposed adjacent the compressor component to form an intermediate pressure region upstream of the seal runner and seal face.

2. The assembly of claim 1, wherein the interaction of the seal face and the seal runner maintains the pressure differential during operation of the engine.

3. The assembly of claim 2, further comprising a carrier operatively interconnected with the mounting bracket to allow the seal face to move axially with respect to the seal runner.

4. The assembly of claim 3, wherein the orifices extend through the carrier from a high-pressure cavity to an intermediate pressure cavity during operation of the gas turbine engine.

5. The assembly of claim 1, further comprising a seal runner integral to a rotating turbomachine component, the seal runner interfacing with the seal face.

6. The assembly of claim 5, further comprising a biasing member connected to the mounting bracket and operative to bias the seal face away from the seal runner.

7. The assembly of claim 6, wherein the biasing member is a spring.

8. An assembly mounted within the compressor section of a gas turbine engine comprising:

a metal seal face;

a mounting bracket connected to a stator component of the gas turbine engine; and a carrier movably interconnected with the mounting bracket, the carrier having orifices which extend therethrough to supply a high-pressure airflow from a high-pressure cavity to an intermediate pressure cavity adjacent the seal face during operation of the gas turbine engine;

a compressor component disposed at an outer diameter of the compressor section having a metal seal runner integral thereto, the seal runner interfacing with the seal face a knife edge and land disposed adjacent the compressor component to form an intermediate pressure region upstream of the seal runner and seal face; and a biasing member connected to the mounting bracket and operative to bias the seal face away from the seal runner.

9. The assembly of claim 8, wherein:

the compressor component comprises a compressor hub and a compressor disk; and the seal runner is provided by a surface of at least one of: the compressor hub and the compressor disk.

10. The assembly of claim 8, wherein:

the compressor component comprises a compressor rear hub; and the seal runner is provided by a surface of the compressor rear hub.

11. The assembly of claim 8, wherein the compressor is a high-pressure compressor.

12. The assembly of claim 8, wherein the carrier and mounting bracket comprise a secondary seal operative to form a seal therebetween.

13. The assembly of claim 8, wherein the seal face is away from the seal runner and is configured to be urged toward the seal runner by gas pressure during operation.

14. The assembly of claim 8, wherein the high-pressure airflow supplied to adjacent the seal face by the orifices allows the seal face to ride against the a film of air during operation of the gas turbine engine.

15. A gas turbine engine comprising:

a compressor;

a shaft interconnected with the compressor; and a turbine operative to drive the shaft;

the compressor having a hydrostatic seal formed by a metal seal face and a metal seal runner, the seal face having orifices that extend therethrough to supply a high-pressure airflow between the seal face the seal runner and a knife edge and land are disposed adjacent the compressor component to form an intermediate pressure region upstream of the seal runner and seal face and wherein the high-pressure airflow allows the seal face to ride against a film of air during operation of the of the gas turbine engine.

16. The engine of claim 15, wherein the compressor is a high-pressure compressor.

17. The engine of claim 15, wherein the engine is a turbofan engine.

18. The engine of claim 15, wherein the seal runner is provided by a surface of the compressor.

19. The engine of claim 18, wherein:

the compressor has a rear hub; and the seal runner is provided by a surface of the rear hub.

* * * * *

UNITED STATES PATENT AND TRADEMARK OFFICE

CERTIFICATE OF CORRECTION

PATENT NO. : 7,797,941 B2
APPLICATION NO. : 11/924899
DATED : September 21, 2010
INVENTOR(S) : Peter M. Munsell and Jorn A. Glahn It is certified that error appears in the above-identified patent and that said Letters Patent is hereby corrected as shown below:

Col. 4, line 56,
delete second "the"

Signed and Sealed this
Twenty-second Day of February, 2011

David J. Kappos

David J. Kappos
*Director of the United States Patent and Trademark Office*

US007797941C1

(12) INTER PARTES REEXAMINATION CERTIFICATE (691st)

United States Patent
Munsell et al.

(10) Number: US 7,797,941 C1
(45) Certificate Issued: Sep. 17, 2013

(54) GAS TURBINE ENGINE SYSTEMS INVOLVING HYDROSTATIC FACE SEALS

(75) Inventors: Peter M. Munsell, Granby, CT (US); Jorn A. Glahn, Manchester, CT (US)

(73) Assignee: United Technologies Corp., Hartford, CT (US)

Reexamination Request:
No. 95/001,884, Feb. 7, 2012

Reexamination Certificate for:

| | |
|---|---|
| Patent No.: | **7,797,941** |
| Issued: | **Sep. 21, 2010** |
| Appl. No.: | **11/924,899** |
| Filed: | **Oct. 26, 2007** |

Certificate of Correction issued Feb. 22, 2011

(51) Int. Cl.
*F02C 1/00* (2006.01)

(52) U.S. Cl.
USPC ..... 60/726; 60/772

(58) Field of Classification Search
None
See application file for complete search history.

(56) References Cited

To view the complete listing of prior art documents cited during the proceeding for Reexamination Control Number 95/001,884, please refer to the USPTO's public Patent Application Information Retrieval (PAIR) system under the Display References tab.

*Primary Examiner* — Joseph A. Kaufman

(57) ABSTRACT

Gas turbine engine systems involving hydrostatic face seals are provided. In this regard, representative compressor assembly for a gas turbine engine includes a compressor having a hydrostatic seal formed by a seal face and a seal runner.

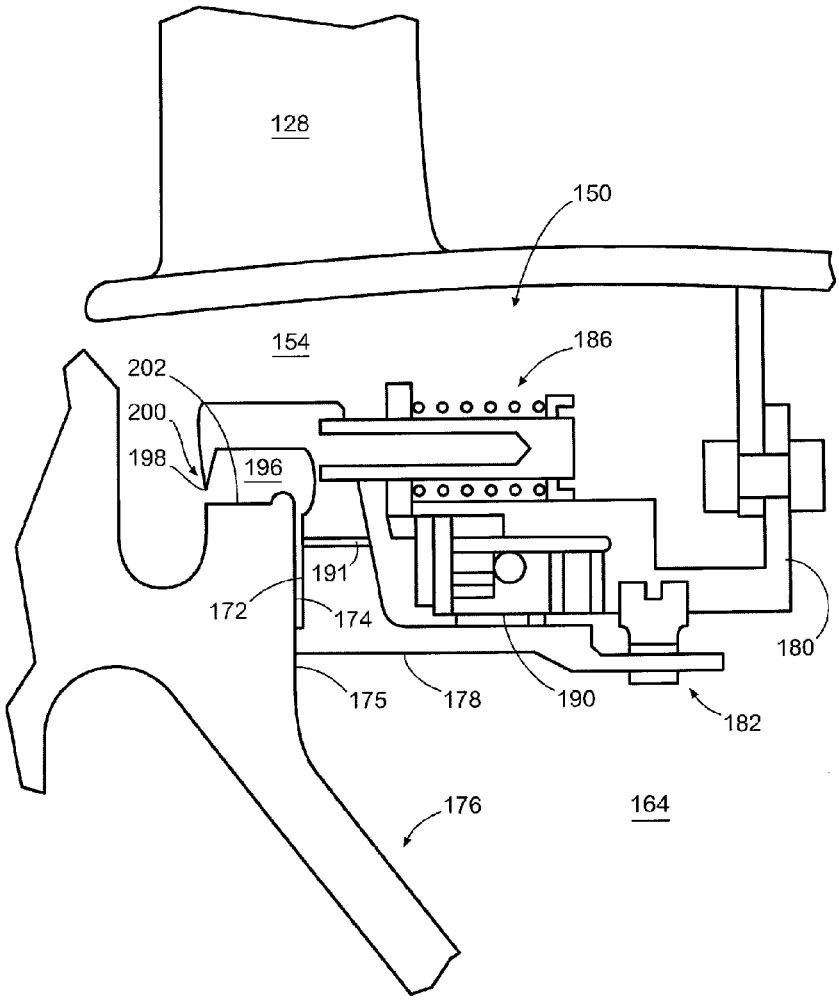

INTER PARTES REEXAMINATION CERTIFICATE ISSUED UNDER 35 U.S.C. 316

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 15 is determined to be patentable as amended.

Claims 16-19, dependent on an amended claim, are determined to be patentable.

Claims 1-14 were not reexamined.

15. A gas turbine engine comprising:

a compressor;

a shaft interconnected with the compressor; and a turbine operative to drive the shaft;

the compressor having a *compressor component disposed at an outer diameter of the compressor and having a metal seal runner integral thereto, a* hydrostatic seal formed by a metal seal face and [a] *the* metal seal runner, the seal face having orifices that extend therethrough to supply a high-pressure airflow between the seal face the seal runner and a knife edge and land are disposed adjacent the compressor component to form an intermediate pressure region upstream of the seal runner and seal face and wherein the high-pressure airflow allows the seal face to ride against a film of air during operation of the of the gas turbine engine.

* * * * *